United States Patent [19]

Pozzebon

[11] Patent Number: 4,790,082

[45] Date of Patent: Dec. 13, 1988

[54] INNER SHOE FOR SKI BOOTS

[75] Inventor: Adolfo Pozzebon, Sala d'Istrana, Italy

[73] Assignee: Nordica S.p.A., Montebelluna TV, Italy

[21] Appl. No.: 56,843

[22] Filed: Jun. 2, 1987

[30] Foreign Application Priority Data

Jun. 20, 1986 [IT] Italy ..... 82547 A/86

[51] Int. Cl.[4] ..... A43B 5/04

[52] U.S. Cl. ..... 36/119; 36/10

[58] Field of Search ..... 36/117–121, 36/9 R, 10, 71, 88, 93, 55

[56] References Cited

U.S. PATENT DOCUMENTS

| | | | |
|---|---|---|---|
| 2,996,814 | 8/1961 | Baker | 36/9 R |
| 3,052,046 | 9/1962 | Kramer | 36/9 R |
| 4,154,009 | 5/1979 | Kubelka et al. | 36/119 |
| 4,499,675 | 2/1985 | Perotto | 36/119 |

FOREIGN PATENT DOCUMENTS

| | | | |
|---|---|---|---|
| 0066133 | 12/1982 | European Pat. Off. | 36/119 |
| 2159086 | 5/1973 | Fed. Rep. of Germany | 36/9 R |
| 2475863 | 8/1981 | France | 36/119 |
| 626793 | 12/1981 | Switzerland | 36/117 |

*Primary Examiner*—James Kee Chi

*Attorney, Agent, or Firm*—Guido Modiano; Albert Josif

[57] ABSTRACT

The inner shoe for ski boots comprises an upper provided with a perimetral border at the end associated with an inner sole. The inner sole is furthermore provided with at least one raised portion and at least one perimetral tab facing and connected to the border of the upper. Advantageously, the central raised portion of the inner sole defines a perimetral edge having a thickness approximately equal to that of the border provided on the upper.

9 Claims, 3 Drawing Sheets

INNER SHOE FOR SKI BOOTS

BACKGROUND OF THE INVENTION

The present invention relates to an inner shoe for ski boots.

Inner shoes are currently known which are sewn and fitted on a last; the assembly initially entails the perimetral sewing of an inner insole, the insertion of the last, the application of an adhesive and the reactivation thereof by heating, the glueing of an inner sole by pressing and then the extraction from the last.

The main disadvantage of such known types of shoes resides in the fact that they have very high costs due to the various processes required, which increase the production times of each individual shoe.

As a partial solution to said disadvantages, a shoe is also known which has a strobel sewing on the perimetral border of the sole for fixing it to the upper.

Though it does not require assembly on a last, this shoe has a less than optimum aesthetical appearance since the sewing of the inner sole is visible, and the shoe itself provides poor heat insulation.

It is furthermore noted that the sewing defines, at the joined perimetral borders, a sharp edge which does not allow correct adaptation to the interior of the shell of the ski boot.

SUMMARY OF THE INVENTION

The main aim of the present invention is therefore to eliminate all of the disadvantages of the known types of inner shoes for ski boots.

Within this main aim, another aim of the invention is to eliminate the disadvantages described above in known types, by devising an inner shoe for ski boots which is simple, rapid and economical to manufacture and which simultaneously provides an aesthetical appearance comparable to similar shoes obtained with the above mentioned more expensive prior art.

Within the scope of these aims, an important object of the invention is to provide an inner shoe for ski boots which associates the previous characteristics to that of providing optimum heat insulation and the possibility of achieving in a simple, rapid and economic manner, characterizing aesthetical finishings for said shoe.

Another important object is to provide an inner shoe which furthermore allows an optimum adaptation to the interior of the shell of the ski boot.

The aim and the objects mentioned above and others which will become apparent hereinafter are achieved by an inner shoe for ski boots, comprising:

an upper having an opening at its lower end;

a perimetral border along said opening;

an inner sole arranged for association with said upper and having a lower surface facing towards the exterior of said upper;

at least one raised portion formed centrally of said inner sole arranged for insertion into the inner edge of said perimetral border and with a top surface facing towards the interior of said upper;

at least one perimetral tab formed in said inner sole peripherally of said raised portion and having an upper surface facing the inside of said upper;

wherein said perimetral border projects towards the inside of said upper to partially occlude said opening ;and wherein said upper surface of said perimetral tab is facing and connected to the lower surface of said perimetral border. In a further aspect of the present invention, the inner shoe comprises:

an upper having a lower end with a sole opening;

a peripheral border defined along said sole opening and projecting towards the inside of said upper;

an inner sole arranged for association with said upper along the outer side of said perimetral border;

an insole arranged for association with said upper along the inner surface of said perimetral border;

a raised portion formed centrally of said insole and shaped substantially complementarily to the inner edge of said perimetral border for insertion thereinto;

a perimetral tab defined peripherally of said insole by said raised portion thereof; wherein the outer surface of said raised insole portion is facing and connected to said inner sole; and wherein said perimetral tab of said insole is facing and connected to said inner surface of said perimetral border whereas the perimetral edge of said inner sole is facing and connected to a complementarily recessed outer portion of said perimetral border.

BRIEF DESCRIPTION OF THE DRAWINGS

Further characteristics and advantages of the invention will become apparent from the detailed description of a particular, but not exclusive, embodiment, illustrated only by way of non-limitative example in the accompanying drawings wherein.

DESCRIPTION OF THE PREFERRED EMBODIMENTS

Figure 1:
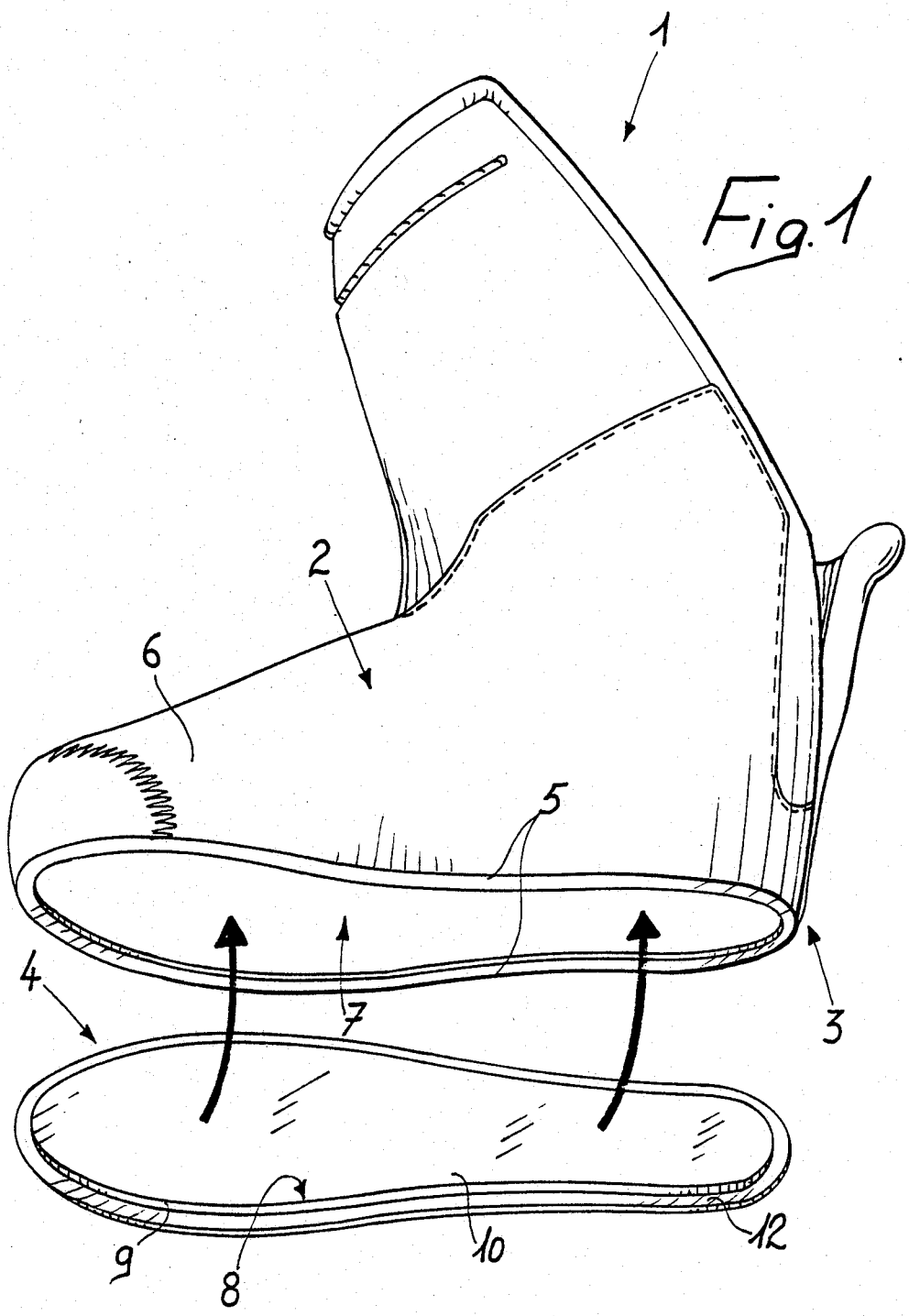
FIG. 1 is a lateral perspective view of the shoe in which, for the sake of clarity, the upper and the inner sole are not coupled.
Figure 2:
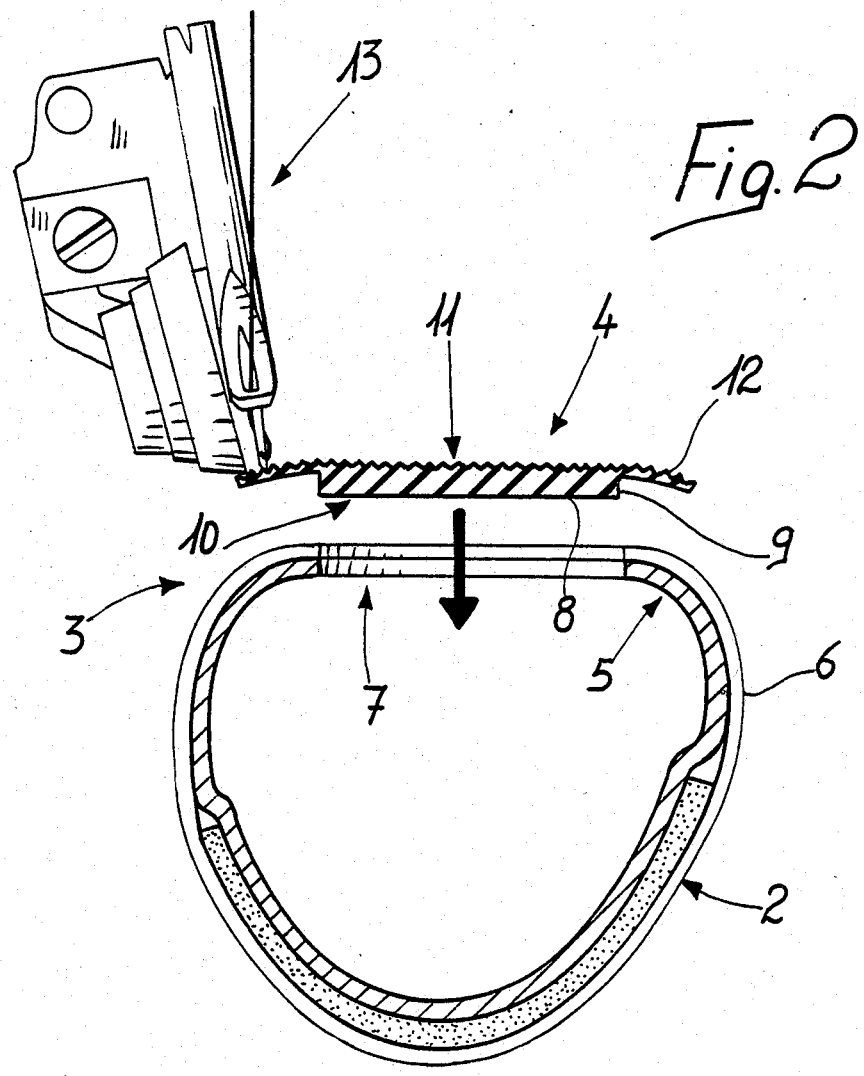
FIG. 2 is a sectional view along a transverse cross section plane of the shoe, illustrating a preferred solution for the upper-inner sole assembly.

With reference to the above described figures, the inner shoe 1, particularly usable for ski boots, consists of an upper 2 having, at the end 3 associable with an inner sole 4, a perimetral border 5.

Said perimetral border 5 protrudes approximately perpendicular to the outer lateral surface 6 of the upper 2, said border partially occluding the opening 7 provided at the end 3 of the upper 2.

The inner sole 4, which can be moulded, heat-formed, electrically formed at high frequency or made by hand with the most suitable materials, with or without a lining, is provided with a raised portion 8 shaped complementarily with respect to the opening 7 defined on the upper 2.

This raised portion 8 has a perimetral edge 9 with thickness approximately equal to that of said perimetral border 5, its surface 10 facing towards the inside of the upper 2 being possibly provided with the most suitable configuration depending on the structure of the foot.

At the surface 11 of the inner sole 4 facing towards the outside of the upper 2, a plurality of knurlings is provided, adapted to increase the grip to the inside of the ski boot shell, in said inner sole there being defined, on the plane of arrangement of the surface 11, a perimetral tab 12 with width approximately equal to that of said perimetral border 5.

The assembly of the upper 2 to the inner sole 4 can occur without the insertion of the last, it being sufficient to insert, practically coupling, the raised portion 8 in the opening 7 of the upper, causing the perimetral tab 12 to mate with the perimetral border 5.

The coupling between said tab 12 and border 5 can be effected for example with chain stitching or with another type of stitching, by means of a suitable sewing machine, preferably of the type having an oscillating arm 13. The lining of the shoe on the border 5 is preferably performed with zig-zag stitching so as to improve the aesthetics. Naturally, the coupling between the border 5 and the tab 2 can be effected by glueing.

It has thus been observed that the invention achieves the intended aims, an inner shoe for ski boots having been obtained which can be assembled in a rapid and simple manner which entails for the latter a very modest cost.

The shoe thus obtained also has a good aesthetical appearance and optimum heat insulation, of a greater degree than that obtainable with known stitched shoes.

The shoe is furthermore provided with a good coupling between the inner sole and the upper, this allowing the optimum adaptation thereof to the interior of the shell of the ski boot.

Moreover, the possibility of applying to the upper's inner soles having the surfaces 10 and 11 with different or specific configurations, depending, for example, on the shape of the foot, allows the achievement of an optimum fit for the user, as well as a desirable aesthetical finish for the shoe.

Naturally, the invention is susceptible to numerous modifications and variations, all of which are within the scope of the same inventive concept.

Figure 3:
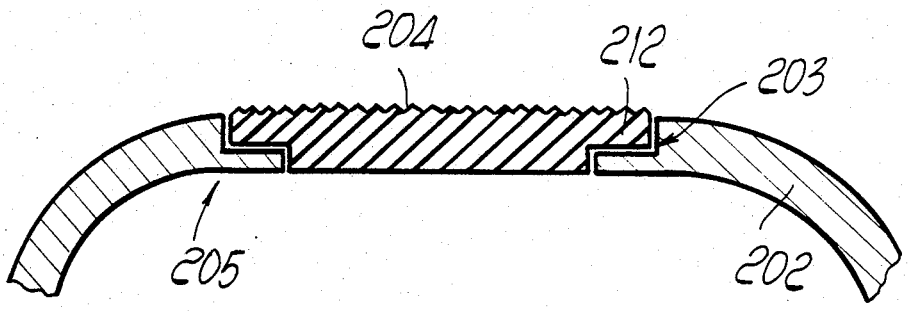
FIGS. 3 and 4 are views, similar to FIG. 2, of further aspects of the inner shoe according to the invention.

FIG. 3 illustrates a further aspect of the shoe according to the invention, in which the edge of the perimetral border 205 of the upper 202 has an abutment 203 for the accommodation of the perimetral tab 212 of the inner sole 204. In this manner a double reference is achieved for the assembly of the inner sole 204 and the upper 202 and most of all both the outer surface and the inner surface of the shoe are absolutely free from raised portions.

Figure 4:
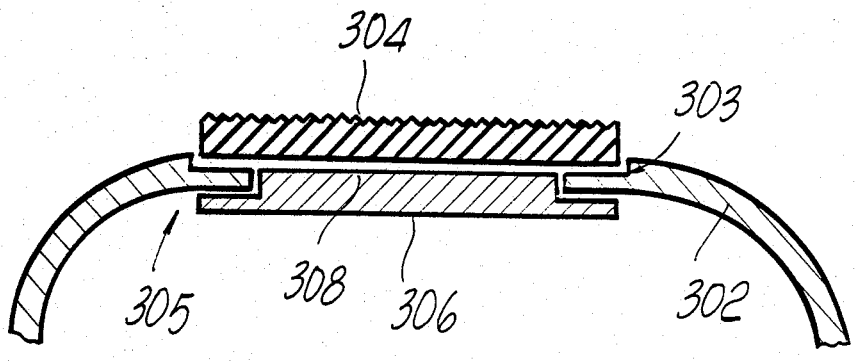

FIG. 4 illustrates yet another embodiment of the shoe, in which the edge of the perimetral border 305 of the upper 302 is also provided with an abutment 303. The inner sole 304, in this case, couples to the upper 302 at the abutment 303. The inner sole comprises, inside the upper 302, an insole 306 having a raised portion 308 shaped complementarily with respect to the opening defined by the edge of the perimetral border 305 of the upper 302. The insole 306 can be rigidly associated with the upper in different manners, for example by means of a single stitching which joins the insole, the vamp and the insole, or by glueing or other known means.

Advantageously, the insole 306 can be extractable from the shoe and in this case the sewing affects only the inner sole and the upper, and can be arranged inside said shoe and coupled to the upper by means of coupling means or simply by employing the raised portion 308 which is shaped complementarily with respect to the opening of the vamp.

Naturally, all the materials, as well as the dimensions of the individual components, may be any according to the specific requirements.

I claim:

1. An inner shoe for ski boots, comprising:

an upper having an opening at its lower end;

a perimetral border along said opening;

an inner sole arranged for association with said upper and having a lower surface facing towards the exterior of said upper;

at least one raised portion formed centrally of said inner sole arranged for insertion into the inner edge of said perimetral border and with a top surface facing towards the interior of said upper;

at least one perimetral tab formed in said inner sole peripherally of said raised portion and having an upper surface facing the inside of said upper;

wherein said perimetral border projects towards the inside of said upper to partially occlude said opening; and wherein said upper surface of said perimetral tab is facing and connected to the lower surface of said perimetral border.

2. An inner shoe according to claim 1, wherein said perimetral border extends substantially perpendicularly to the lateral surface of said upper.

3. An inner shoe according to claim 1, wherein the lower surface of said perimetral tab facing towards the outside of said upper extends substantially flush with said lower surface of said inner sole.

4. An inner shoe according to claim 1, wherein the top surface of said raised portion is arranged to substantially conform to a wearer's foot.

5. An inner shoe according to claim 1, wherein said perimetral border has an inner edge complementarily shaped with respect to the lateral surface of said raised portion, said raised portion having a height substantially equal to the thickness of said perimetral border.

6. An inner shoe according to claim 1, wherein the width of said perimetral tab is substantially equal to that of said perimetral border.

7. An inner shoe according to claim 1, wherein said perimetral border has an inner edge of stepped configuration defining an inner portion substantially complementarily shaped with respect to said raised portion and an outer abutmnent ortion substantially complementarily shaped with respect to the outer edge of said perimetral tab of said inner sole to provide an abutment for said perimetral tab.

8. An inner shoe according to claim 7, wherein said outer abutment portion for said perimetral tab has a height substantially equal to the thickness of said perimetral tab.

9. An inner shoe for ski boots, comprising:

an upper having a lower end with a sole opening;

a peripheral border defined along said sole opening and projecting towards the inside of said upper;

an inner sole arranged for association with said upper along the outer side of said perimetral border;

an insole arranged for association with said upper along the inner surface of said perimetral border a raised portion formed centrally of said insole and shaped substantially complementarily to the inner edge of said perimetral border for insertion thereinto;

a perimetral tab defined peripherally of said insole by said raised portion thereof;

wherein the outer surface of said raised insole portion is facing and connected to said inner sole; and wherein said perimetral tab of said insole is facing and connected to said inner surface of said perimetral border whereas the perimetral edge of said inner sole is facing and connected to a complementarily recessed outer portion of said perimetral border.

* * * * *